US005545878A

United States Patent [19]

Jasper, II et al.

[11] Patent Number: 5,545,878

[45] Date of Patent: Aug. 13, 1996

[54] DEFROST HEATER WITH SPIRAL VENT

[75] Inventors: William C. Jasper, II, Frankfort; Cheryl S. Middleton, Argos; Ronald G. Prusinski, Plymouth, all of Ind.

[73] Assignee: Wirekraft Industries, Inc., Mishawaka, Ind.

[21] Appl. No.: 337,997

[22] Filed: Nov. 10, 1994

[51] Int. Cl.[6] ..... H05B 3/08; F25B 47/00

[52] U.S. Cl. ..... 219/541; 62/276; 62/277

[58] Field of Search ..... 219/541, 546, 219/523, 542; 62/150, 151, 272, 275, 276

[56] References Cited

U.S. PATENT DOCUMENTS

| | | | |
|---|---|---|---|
| 3,359,750 | 12/1967 | Hanson | 62/276 |
| 4,156,128 | 5/1979 | Craven | 219/523 |
| 4,186,369 | 1/1980 | Attridge | 219/541 |
| 4,369,350 | 1/1983 | Kobayashi | 62/276 |
| 4,376,244 | 3/1983 | Gellert | 219/123 |
| 4,388,523 | 6/1983 | Keep | 219/541 |

*Primary Examiner*—Teresa J. Walberg
*Assistant Examiner*—Sam Paik
*Attorney, Agent, or Firm*—Baker & Daniels

[57] ABSTRACT

A defrost heater for a refrigerator, freezer or other appliance having evaporator coils upon which moisture condenses and freezes includes a glass tube having an electrical resistance heating wire within the tube. A pair of connectors on opposite ends of the tube support a conductor for supplying electrical energy to the resistance heating wire. A spiral vent path in at least one of the conductors circumscribes the surface of the conductor and engages the outer surface of the tube to thereby provide an elongated, circuitous vent path which permits venting of air within the tube as it is heated, but prevents moisture from being drawn into the tube. A resilient sealing member defines a bore receiving the conductor to prevent moisture from entering the connector around the conductor.

18 Claims, 3 Drawing Sheets

DEFROST HEATER WITH SPIRAL VENT

This invention relates to a defrost heater for defrosting the evaporator coils of refrigerators, freezers, and other similar appliances.

BACKGROUND OF THE INVENTION

Refrigerators, freezers, and similar appliances have evaporator coils upon which moisture condenses and freezes during normal operation of the appliance. These appliances are commonly provided with defrost heaters, which periodically are turned on to heat the coils to a temperature sufficient to melt the accumulated moisture frozen on the coils. The moisture, then as a liquid, drains into an evaporator pan where it evaporates. One common type of defrost heater includes an electrical resistance heating element enclosed within a glass tube which is mounted just below the evaporator coils. Connectors at both ends of the tube connect electrical conductors with the heating element for supplying electrical energy thereto. These heaters are normally mounted just below the evaporator coils. Accordingly, the melting moisture drops onto the heater, must be prevented from reaching the resistance heating element enclosed within the glass tube. However, the resistance heating element in heating the air within the tube causes the air to expand, which will break the tube if not vented. Accordingly, it is necessary to provide a vent for the tube, but this vent also serves as a path through which the melting moisture can reach the inside of the tube and damage the resistance heating element. In fact, some test specifications require that the heater be able to function if entirely immersed in water. Most glass defrost heaters having vents are unable to pass this test, because of water leaking into the glass tube through the vent.

SUMMARY OF THE INVENTION

The present invention provides a glass defrost heater in which the opposite ends of the glass tube are supported by connectors which also support electrical conductors which supply electrical energy to the heating element. The connectors have an inner circumferential surface which engages the outer circumferential surface of the glass tube. A spiral path is cut into the circumferentially extending surface of the connector, which provides a vent path from the inside of the tube (through the open end thereof which is received within the connector) to atmosphere through the spiral path. However, because of the length of the spiral path, the fact that the groove is extremely shallow (cut to a depth of only about 0.005", although the exact depth and shape of the groove may vary depending upon the application), the fact that the connector is made out of a moisture repelling material, such as silicon rubber, and the fact that water molecules are larger than the molecules of the gasses constituting atmospheric air, moisture is prevented from reaching the inside of the tube, although a vent path allowing the glass tube to "breathe" during operation of the electric resistance heater is provided. Accordingly, the present invention has the advantage of providing a vent path to allow air enclosed within the glass tube of a glass defrost heater to be able to expand and escape from the tube during operation of the resistance heater while preventing entry of moisture into the tube. Another advantage of the invention is to assure that moisture cannot be drawn into the vent passage provided in a glass defrost during defrost cycles.

BRIEF DESCRIPTION OF THE DRAWING

These and other advantages of the present invention will become apparent from the following description, with reference to the accompanying drawings, in which.

DESCRIPTION OF THE PREFERRED EMBODIMENT

Figure 1:
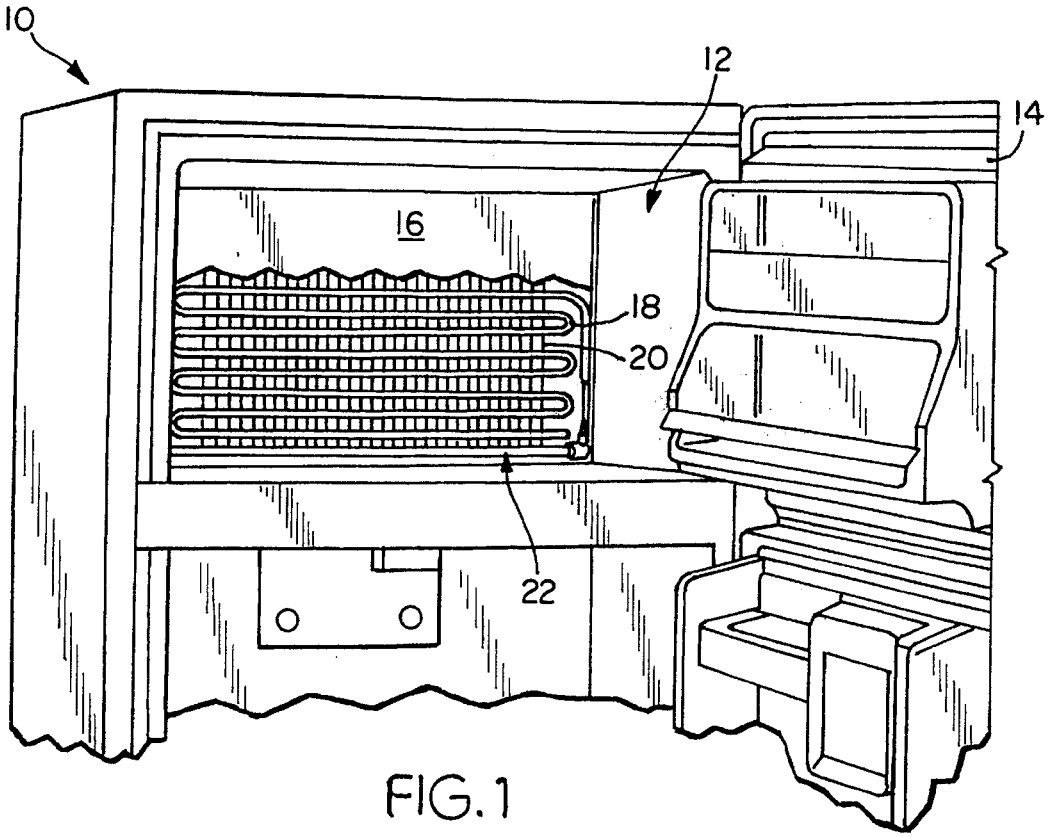
FIG. 1 is a perspective view of a conventional household refrigerator, with a portion of the back panel of the freezing compartment broken away to illustrate the evaporator coils and the glass defrost heater made pursuant to the teachings of the present invention.
Figure 2:
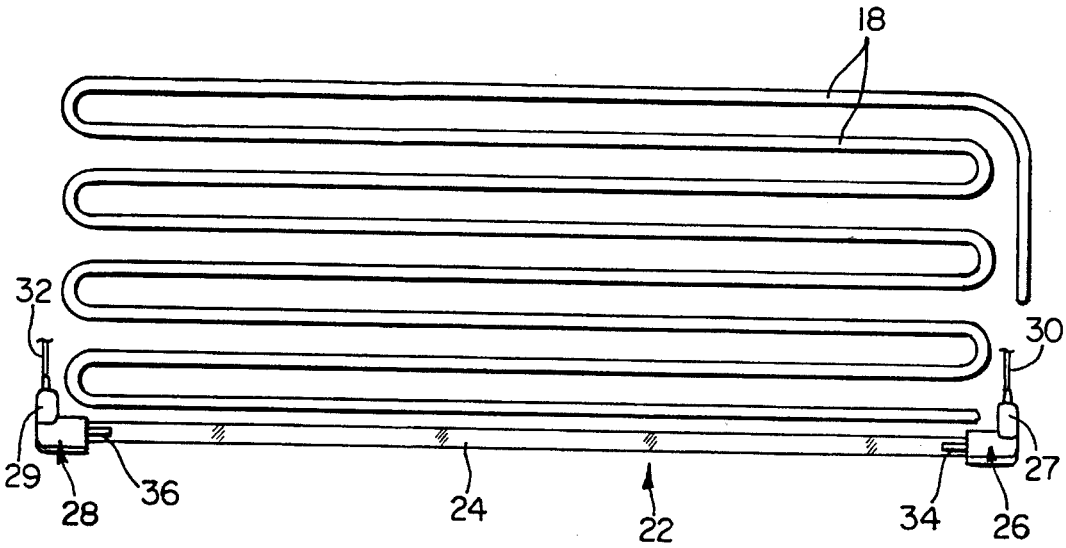
FIG. 2 is a schematic illustration of the evaporator coils (with the cooling fins omitted) and the glass defrost heater according to the present invention.
Figure 6:
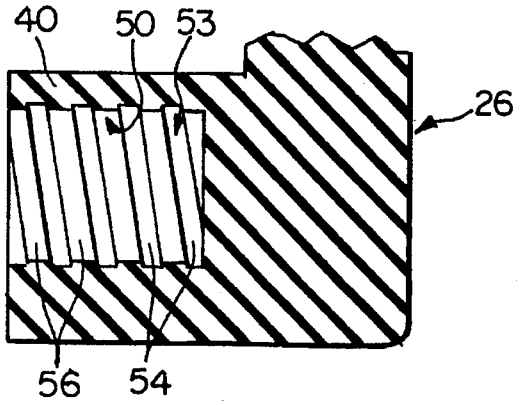
FIG. 6 is a fragmentary cross-sectional view taken substantially along lines 6—6 of FIG. 5.
Figure 3:
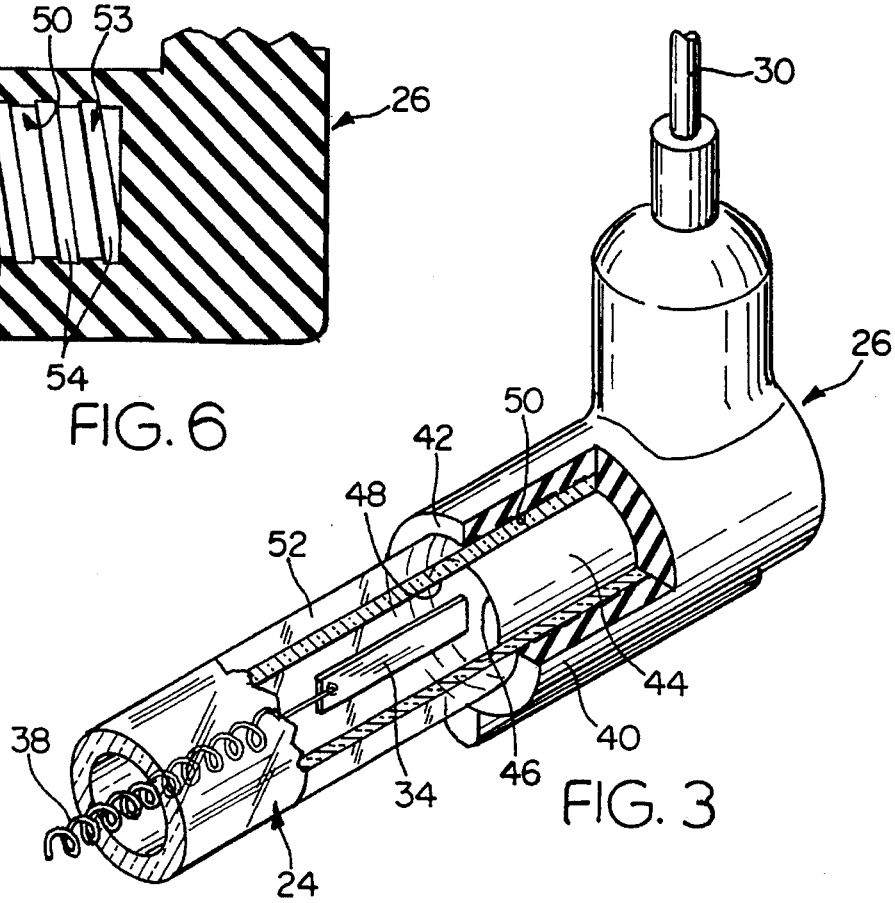
FIG. 3 is a view in perspective, partly in section, of the end portion of a glass defrost heater according to the present invention.
Figure 5:
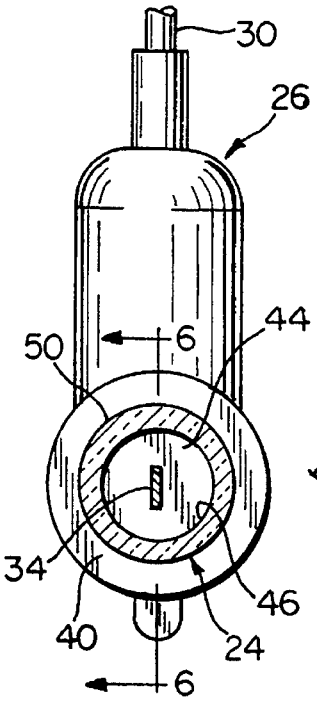
FIG. 5 is a view taken substantially along line 5—5 of FIG. 4.
Figure 4:
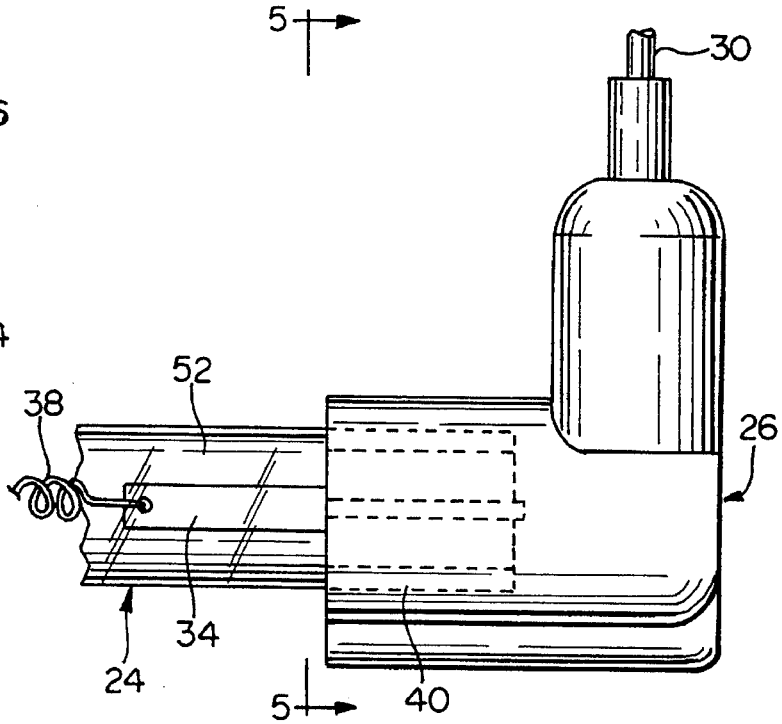
FIG. 4 is a side view of the glass defrost heater illustrated in FIG. 3.
Figure 7:
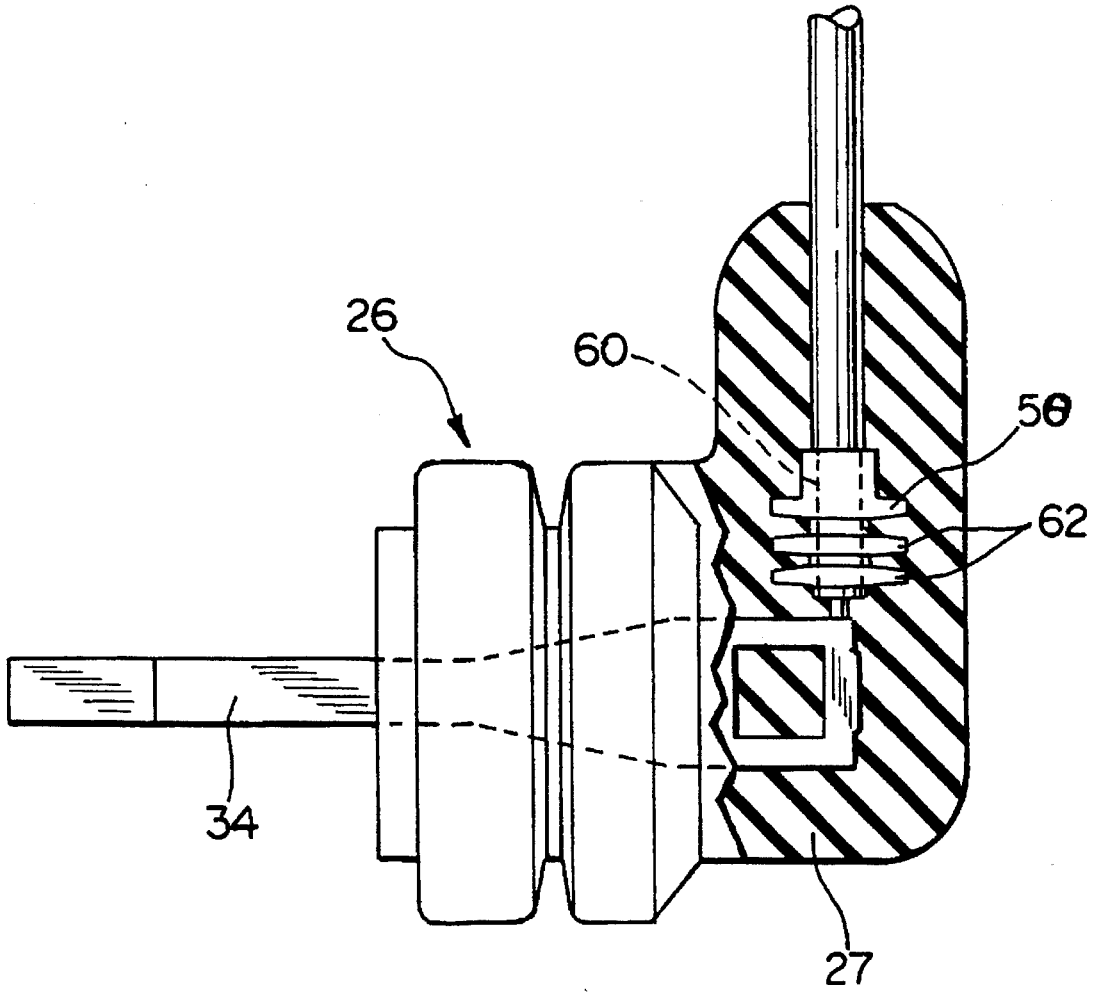
FIG. 7 is a fragmentary side elevational view, partly in section, of a portion of the defrost heater made pursuant to the teachings of the present invention.

Referring now to the drawings, a conventional household refrigerator generally indicated by the numeral 10 includes a freezing compartment 12 (illustrated in FIG. 1 with the door 14 open). A portion of the back panel 16 has been broken away in FIG. 1 to show evaporator coils 18 connected by heat transferring fins 20. The evaporator coils are filled with a cooling medium, and are connected to the refrigeration circuit of the refrigerator 10.

A glass defrost refrigeration heater generally indicated by the numeral 22 which is made according to the teachings of the present invention, is mounted just below the evaporator coils 18. During normal use of the refrigerator 10, atmospheric moisture condenses and freezes on the evaporator coils 18, which must be periodically defrosted. Accordingly, the glass defrost heater 22 is operated on a regular basis to heat the coils 18 (heat generated by the heater 22 being conducted to the coils 18 by convection), to thereby melt the moisture which is frozen on the coils 18. The moisture melting from the coils 18 drips down over the heater 22 and into an evaporator pan (not shown) usually mounted just underneath the refrigerator 10.

The glass defrost heater 22 includes a glass tube 24 which extends across the length of the coils 18. Connectors 26, 28 close the opposite open ends of the glass tube 24. Each of the connectors 26, 28 includes a housing portion 27, 29 which supports a conductor 30, 32. The conductors 30, 32 extend through their corresponding connectors 26, 28 and terminate in a flat extension 34, 36, which project at substantially a right angle with respect to the corresponding conductor 30 or 32. The extensions 34,36 connect with opposite ends of a conventional electrical resistance heating wire 38. The conductors 30, 32 complete a circuit between resistance heating wire 38 and a source of electrical energy. As illustrated in FIG. 3–6, the connector 26 includes a projecting portion 40 which includes an outer projecting section 42 and an inner projecting section 44 which cooperate to define a annular recess therebetween to receive one end of the glass tube 24. It should be noted that the inner projecting section 44 includes an outer circumferential surface 46 which engages the inner circumferential surface 48 of the glass tube 24 to support and retain the latter to the connector 26, but does not sealingly engage the latter, so that a vent path is provided for the heated air enclosed within the tube 24.

The outer projecting section 42 includes an inner circumferential surface 50 which engages the outer circumferential surface 52 of the glass tube 24. The inner circumferential surface 50 is provided with a spiral groove 53, the turns 54 of which are separated by spiralling extending, radially inwardly projecting sealing portion 56. The spiral groove 53 defines a circuitous path communicating the end of tube 24 with ambient atmosphere. The sealing portion 56 sealingly engage the outer circumferential surface 52 of glass tube 24, while the spiral path 53 provides a vent which extends between the end of the tube 24 received in connector 26 and ambient atmosphere. The depth of the groove 53 is about 0.005" but the exact shape and depth of the groove 53 may vary depending upon the application.

The housing portions 27, 29 of the connectors 26, 28 are preferably made of a silicone rubber material, which does not adhere well to the insulating material around the conductors 30, 32, so that leakage of moisture into the housing portion 27 or 29 may occur. Accordingly, a convoluted sealing member 58 made of a flexible, silicone rubber material is mounted on the insulation surrounding the corresponding conductor 30, 32. The sealing member 58 is provided with a bore 60 of a diameter slightly smaller than that of the insulation surrounding the conductor, so that the resiliency of the material from which the sealing member is made causes the walls of the bore 60 to sealingly engage the insulation surrounding the conductor. Since both the housing portion 29 and the sealing member 58 are both made of a compatible silicone rubber material, the material of the housing portion 29 readily adheres to the material of the sealing member 58, thereby effecting a water tight seal therebetween. The sealing member 58 is further provided with convolutions 62, to thereby further assure that the sealing member 58 will be captured within the housing portion 29 during encapsulation.

Since the connector 28 is substantially identified to the connector 26, connector 28 will not be described in detail.

Accordingly, the air within the tube 24, which expands as it is heated by the resistance heating wire 38, is able to vent to atmosphere around the end of the tube and then through the spiral path 53. However, since the spirals 54 of the spiral path 53 are only about 0.005 inches deep, because of the relatively long length of the spiral path 53, and because the connector 26 is made from a water repellant material, such as a silicone-based rubber, water molecules are prevented from being drawn into the tube 24 due to capillary action when the heater is not engaged. The defrost heater 22 may even be immersed in water (when the heater is not energized) without water entering into the tube 24; again, the length of the path, the small depth of the groove, the water repellency of the material from which the connector 26, 28 are manufactured, and the fact that water molecules are significantly larger than the molecules of the gases constituting atmospheric air, moisture will not be drawn into the tube 24. Because the sealing member 58 is forcibly engaged with the insulation around the conductor and because the sealing member is encapsulated by the housing portion 27, 29 of the corresponding connector 26, 28, leakage into the connector around the insulation surrounding the corresponding conductor is also prevented.

We claim:

1. Defrost heater comprising a tube having opposite open ends and an inner circumferential surface defining a chamber extending between the open ends of said tubes, an electrical resistance heating element in said chamber extending through said tube between the ends thereof, a connector mounted on one end of the tube, said connector supporting an electrical conductor connected to said heating element for supplying electrical energy thereto, said connector including a circuitous path between the chamber through the open end of the tube and ambient atmosphere to vent a heated air enclosed within said chamber.

2. Defrost heater as claimed in claim 1, wherein said circuitous path is a spiral passage on said connector circumscribing said tube.

3. Defrost heater as claimed in claim 1, wherein said connector has a projecting portion defining a recess receiving said one end of the tube, said circuitous path being defined on said projecting portion.

4. Defrost heater as claimed in claim 3, wherein said circuitous path is a spiral passage carried by said projecting portion.

5. Defrost heater as claimed in claim 3, wherein said tube defines an outer circumferential surface and said recess is defined by an inner circumferential surface of said projecting portion, said inner circumferential surface sealingly receiving the outer circumferential surface of the tube, said circuitous path including a passage in said inner circumferential surface communicating the one end of the tube with ambient atmosphere.

6. Defrost heater as claimed in claim 5, wherein said passage is a spiral groove in said inner circumferential surface circumscribing the outer circumferential surface of the tube.

7. Defrost heater as claimed in claim 6, wherein said inner circumferential surface is defined by a radially projecting, spirally extending sealing portion circumscribing said tube and defining the spiral groove, said sealing portion sealingly engaging the outer circumferential surface of the tube.

8. Defrost heater as claimed in claim 6, wherein said connector is made of a moisture repelling sealing material.

9. Defrost heater as claimed in claim 8, wherein said material is silicone rubber.

10. Defrost heater as claimed in claim 6, wherein the depth of the spiral groove is about 0.005".

11. Defrost heater as claimed in claim 3, wherein said tube defines inner and outer circumferential surfaces, said projecting portion includes an outer section cooperating with an inner section to define and annular recess therebetween, said outer section having an inner circumferential surface and said inner section having an outer circumferential surface, said one end of the tube being received within the recess such that the inner circumferential surface of the outer section engages the outer circumferential surface of the tube and the outer circumferential surface of the inner section engages the inner circumferential surface of the tube, said circuitous path being a passage in the inner circumferential surface of the outer section communicating the one end of the tube with ambient atmosphere.

12. Defrost heater as claimed in claim 11, wherein said passage is a spiral groove in said inner circumferential surface of the outer section.

13. Defrost heater as claimed in claim 12, wherein said inner circumferential surface of said outer section is defined by a radially projecting, spirally extending sealing portion circumscribing said tube and defining the spiral groove, said sealing portion sealingly engaging the outer circumferential surface of the tube.

14. Defrost heater as claimed in claim 13, wherein said connector is made of a moisture repelling sealing material.

15. Defrost heater as claimed in claim 14, wherein said material is silicone rubber.

16. Defrost heater as claimed in claim 12, wherein the depth of the spiral groove is about 0.005".

17. Defrost heater as claimed in claim 1, wherein a resilient sealing member circumscribes said conductor, said conductor carrying insulative material between the sealing member and the conductor, the resiliency of said sealing member preventing moisture from entering between the sealing member and the insulative material, said sealing member being encapsulated within said connector.

18. Defrost heater as claimed in claim 17, wherein said sealing member includes convolutions embedded within the connector.

* * * * *